US008735698B2

(12) United States Patent
Matsuo et al.

(10) Patent No.: US 8,735,698 B2
(45) Date of Patent: May 27, 2014

(54) DRIVE MECHANISM OF LIFTING RAIL FOR MUSICAL INSTRUMENT AND MUSICAL INSTRUMENT INCLUDING THE SAME

(71) Applicant: Yamaha Corporation, Hamamatsu (JP)

(72) Inventors: Yoshiya Matsuo, Hamamatsu (JP); Yasuhiko Oba, Hamamatsu (JP); Yuji Fujiwara, Hamamatsu (JP)

(73) Assignee: Yamaha Corporation, Hamamatsu-Shi, Shizuoka-Ken (JP)

( * ) Notice: Subject to any disclaimer, the term of this patent is extended or adjusted under 35 U.S.C. 154(b) by 0 days.

(21) Appl. No.: 13/743,771

(22) Filed: Jan. 17, 2013

(65) Prior Publication Data

US 2013/0180376 A1 Jul. 18, 2013

(30) Foreign Application Priority Data

Jan. 18, 2012 (JP) ..... 2012-008405

(51) Int. Cl.
*G10C 3/00* (2006.01)

(52) U.S. Cl.
USPC ..... 84/216

(58) Field of Classification Search
None
See application file for complete search history.

(56) References Cited

U.S. PATENT DOCUMENTS

| | | | | |
|---|---|---|---|---|
| 4,450,749 | A * | 5/1984 | Stahnke | 84/462 |
| 5,016,513 | A * | 5/1991 | Stahnke | 84/19 |
| 5,714,702 | A * | 2/1998 | Ishii | 84/462 |
| 6,632,988 | B1 * | 10/2003 | Jones et al. | 84/216 |
| 7,332,670 | B2 * | 2/2008 | Fujiwara et al. | 84/744 |
| 2013/0180376 | A1 * | 7/2013 | Matsuo et al. | 84/225 |
| 2013/0180377 | A1 * | 7/2013 | Oba et al. | 84/229 |
| 2013/0180391 | A1 * | 7/2013 | Oba et al. | 84/746 |

FOREIGN PATENT DOCUMENTS

JP 2002-014669 A 1/2002

* cited by examiner

*Primary Examiner* — Robert W Horn
(74) *Attorney, Agent, or Firm* — Dickstein Shapiro LLP

(57) ABSTRACT

A drive mechanism of a lifting rail for a musical instrument including a lifting rail, the drive mechanism including: a connection member connected to the lifting rail; and a movement-force giving mechanism configured to move the lifting rail via the connection member, wherein the lifting rail includes: a hollow portion opening at one end; and a through-hole formed through an upright wall portion of the lifting rail, wherein the connection member includes: an insertion member having an attachment hole corresponding to the through-hole; a fixing member for connecting the lifting rail and the connection member; and a contact portion configured to come into contact with the one end of the lifting rail when the insertion member is inserted in the hollow portion by a prescribed distance so as to prevent the insertion member from being further inserted in the hollow portion, thereby positioning the attachment hole relative to the through-hole.

15 Claims, 9 Drawing Sheets

DRIVE MECHANISM OF LIFTING RAIL FOR MUSICAL INSTRUMENT AND MUSICAL INSTRUMENT INCLUDING THE SAME

CROSS REFERENCE TO RELATED APPLICATION

The present application claims priority from Japanese Patent Application No. 2012-008405 filed on Jan. 18, 2012, the disclosure of which is herein incorporated by reference in its entirety

BACKGROUND OF THE INVENTION

1. Field of the Invention

The present invention relates to a technique for driving dampers of a musical instrument.

2. Description of Related Art

One example of a musical instrument equipped with damper mechanisms is a piano. The following Patent Literature 1 discloses an automatic playing piano as a piano in which dampers are driven by actuators. The disclosed piano has a solenoid, and a loud lever is in contact with a plunger of the solenoid. The loud lever is supported by a fulcrum and rotates about the fulcrum when pushed by the plunger, thereby pushing up a lifting push rod.

When the lifting push rod is pushed up, a lifting rail which is in contact with an upper end of the lifting push rod is pushed up, so that all of the dampers which are in pressing contact with associated strings are forcibly separated therefrom. As a result, sounds by the strings continue to be generated. This is because the dampers are spaced apart from the strings in a time period during which the lifting rail is pushed up, irrespective of whether keys are depressed or not.

The loud lever is provided with a lever return spring which gives, to the loud lever, a force in a direction opposite to a direction in which the lifting push rod is pushed up. Accordingly, when the solenoid is de-energized, the loud lever returns back to its original position and the dampers come into pressing contact with the strings.

Patent Literature 1: JP-A-2002-14669

SUMMARY OF THE INVENTION

In a musical instrument equipped with the damper mechanisms, the lifting rail needs to be pushed up for forcibly separating the dampers all at once from the sound generating members such as the strings.

In the piano disclosed in the Patent Literature 1, when the lifting rail is pushed up by an actuator (solenoid), the force of the actuator is transmitted to the lifting rail via the loud lever and the lifting push rod.

If members other than the lifting rail are moved, e.g., the loud lever and the lifting push rod are moved when the lifting rail is pushed up, a drive force to be required for pushing up the lifting rail is increased. Further, a noise which is generated when the lifting rail is pushed up is also increased.

The present invention has been developed in the situations described above. It is therefore a first object of the invention to provide a drive mechanism of a lifting rail for a musical instrument in which a required drive force is reduced and a noise to be generated is reduced, when dampers are driven all at once using an actuator. It is a second object of the invention to provide a musical instrument including such a drive mechanism. It is a third object of the invention to provide a method of producing such a drive mechanism.

The first object indicated above may be achieved according to a first aspect of the present invention, which provides a drive mechanism of a lifting rail for a musical instrument which comprises: dampers each configured to come into contact with a sound generating member provided for a corresponding one of a plurality of keys for generating a sound of one of a plurality of pitches that are generated by the musical instrument, so as to suppress a vibration of the sound generating member; damper levers each connected to a corresponding one of the dampers directly or indirectly for moving the damper away from the sound generating member in accordance with depression of a corresponding one of the plurality of keys; and a lifting rail having a bar-like configuration and configured to operate all of the damper levers, such that each of the dampers is spaced apart from the sound generating member, the drive mechanism comprising:

a connection member to be connected to one end of the lifting rail; and a movement-force giving mechanism configured to move the lifting rail via the connection member in accordance with a signal to be inputted thereto, wherein the lifting rail includes: a hollow portion which is open at the one end of the lifting rail; and a through-hole which is formed through an upright wall portion of the lifting rail which stands in a vertical direction and which is one of a plurality of wail portions of the lifting rail situated between the hollow portion and an exterior of the lifting rail, wherein the connection member includes: an insertion member in which an attachment hole is formed at a position corresponding to the through-hole and which is to be inserted in the hollow portion of the lifting rail; and a fixing member configured to be inserted into the through-hole and the attachment hole for connecting the lifting rail and the connection member, and wherein the connection member includes a contact portion configured to come into contact with the one end of the lifting rail when the insertion member is inserted in the hollow portion by a prescribed distance so as to prevent the insertion member from being further inserted in the hollow portion, thereby positioning the attachment hole relative to the through-hole.

The second object indicated above may be achieved according to a second aspect of the present invention, which provides a musical instrument, comprising:

the drive mechanism of the lifting rail defined as described above;

a performance-instruction-data obtaining section configured to obtain performance instruction data which instructs: generation of sounds constituting a music piece; and attributes associated with the generation of the sounds, and a signal generating section configured to generate signals to be inputted to the movement-force giving mechanism, according to the performance instruction data obtained by the performance-instruction-data obtaining section.

The third object indicated above may be achieved according to a third aspect of the present invention, which provides a method of producing a drive mechanism of a lifting rail for a musical instrument which comprises: dampers each configured to come into contact with a sound generating member provided for a corresponding one of a plurality of keys for generating a sound of one of a plurality of pitches that are generated by the musical instrument, so as to suppress a vibration of the sound generating member; damper levers each connected to a corresponding one of the dampers directly or indirectly for moving the damper away from the sound generating member in accordance with depression of a corresponding one of the plurality of keys; and a lifting rail having a bar-like configuration and configured to operate all of the damper levers, such that each of the dampers is spaced apart from the sound generating member, wherein the drive mechanism comprises: a connection member connected to one end of the lifting rail; and a movement-force giving mechanism configured to move the lifting rail via the connection member in accordance with signals to be inputted thereto, the method comprising the steps of inserting an insertion member of the connection member into a hollow portion of the lifting rail which is open at the one end of the lifting rail;

permitting a contact portion of the connection member to come into contact with the one end of the lifting rail when the insertion member is inserted in the hollow portion by a prescribed distance; and fixing the connection member and the lifting rail in a state in which the contact portion is in abutting contact with the one end of the lifting rail.

BRIEF DESCRIPTION OF DRAWINGS

The above and other objects, features, advantages and technical and industrial significance of the present invention will be better understood by reading the following detailed description of embodiments of the invention, when considered in connection with the accompanying drawings, in which.

DETAILED DESCRIPTION OF THE EMBODIMENTS

Figure 1:
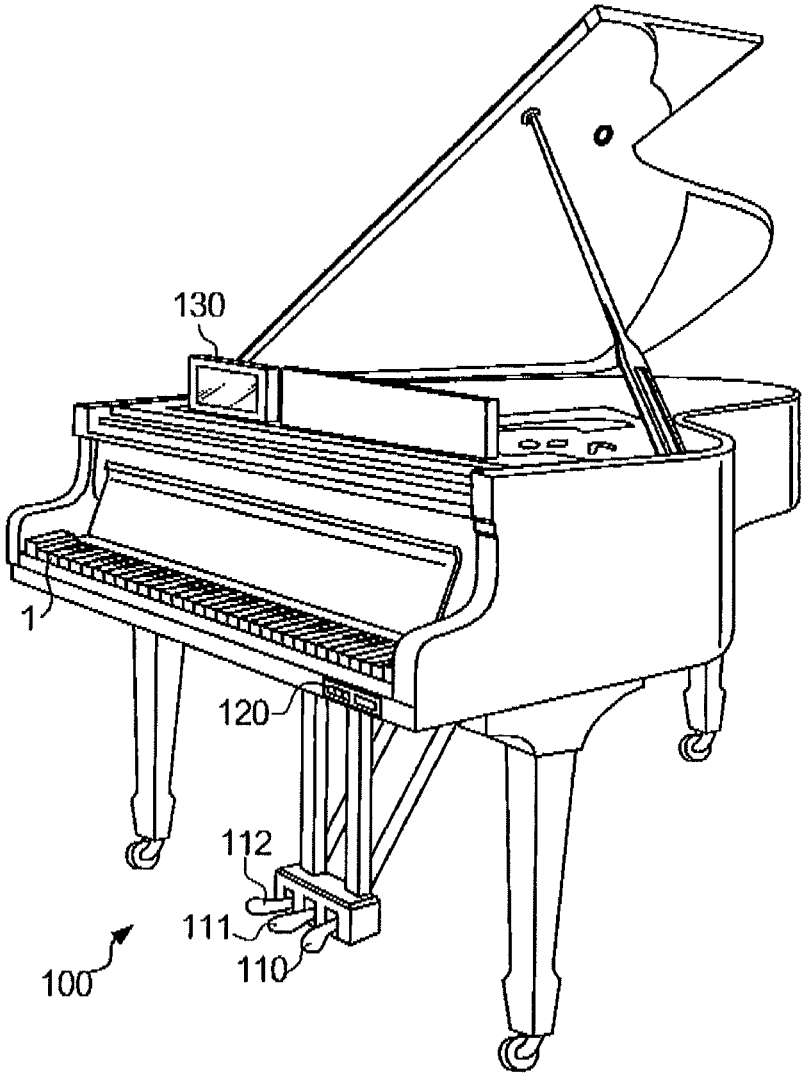
FIG. 1 is an external view of an automatic playing piano according to one embodiment of the present invention.

FIG. 1 is an external view of an automatic playing piano 100 according to one embodiment of the present invention. In the following explanation, a player's side of the piano 100 on which a player is situated is referred to as a front side while an opposite side to the player's side is referred to as a rear side, and a right side and a left side as seen from the player are referred to as a right side of the piano 100 and a left side of the piano 100, respectively. Further, the lateral direction parallel to a direction in which keys 1 are arranged is referred to as a left-and-right direction, and a direction perpendicular to the left-and-right direction and parallel to the horizontal direction is referred to as a front-wad-rear direction, namely, a longitudinal direction of each key is referred to as the front-and-rear direction.

The automatic playing piano 100 has a plurality of keys 1 on the front side and has, below the keys 1, a damper pedal 110, a sostenuto pedal 111, and a soft pedal 112 which are disposed in order from the right to the left. The automatic playing piano 100 further has an access portion 120 configured to read performance instruction data in the MIDI format (Musical Instrument Digital Interface) from a recording medium such as a DVD (Digital Versatile Disk) or a CD (Compact Disk) in which the performance instruction data is recorded. In addition, the automatic playing piano 100 has an operation panel 130 beside a music stand. The operation panel 130 is a touch panel for accepting instructions from the player and is configured to display various menu screens for operating the automatic playing piano 100.

Figure 2:
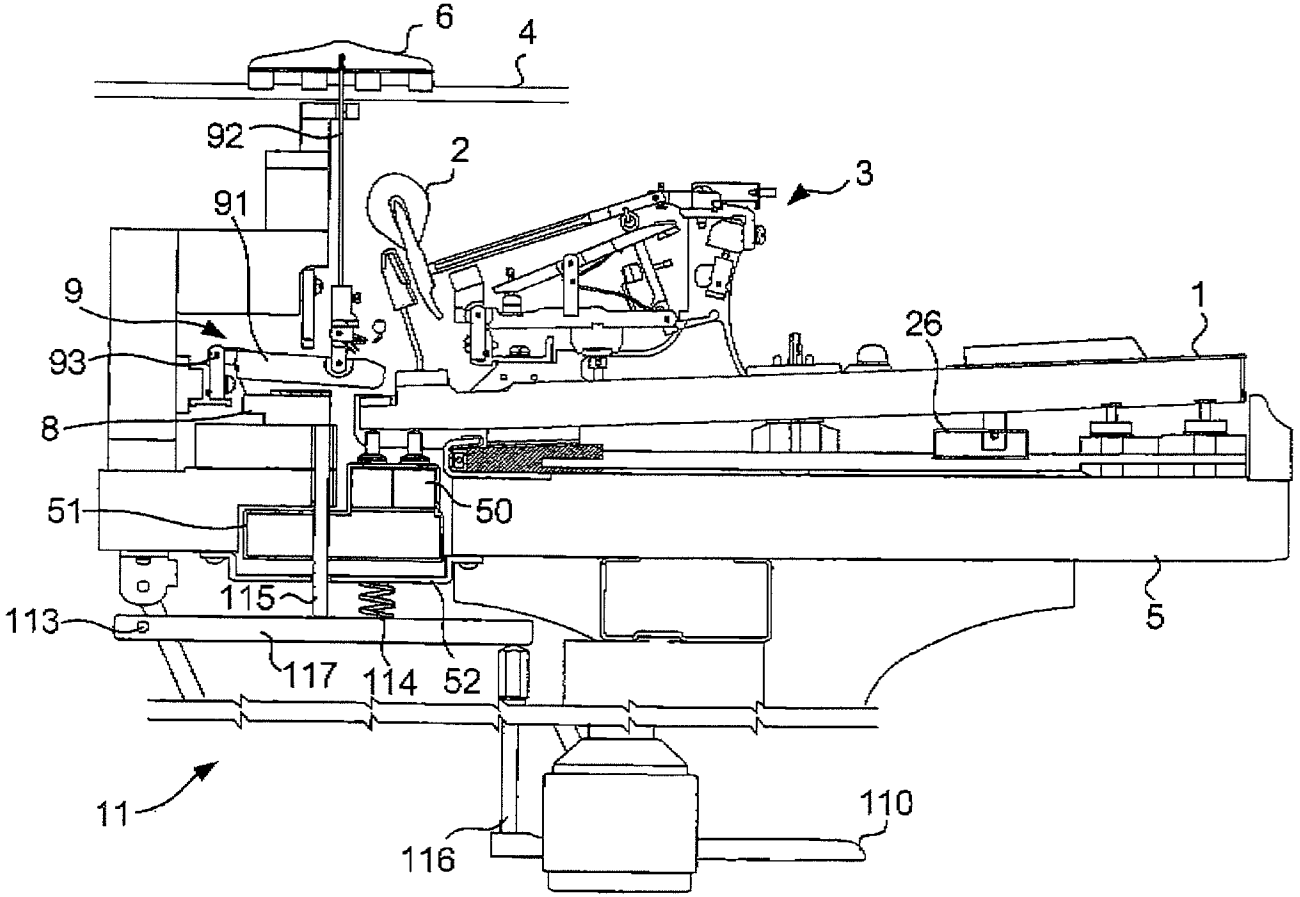
FIG. 2 is a schematic view showing an internal mechanical structure of the automatic playing piano according to the embodiment of the present invention.

FIG. 2 is a schematic view showing an internal mechanical structure of the automatic playing piano 100 as viewed from the left side. The automatic playing piano 100 includes, for each of the plurality of keys 1, at least one (from one to three) string 4 (each as a sound generating member) configured to vibrate by being struck so as to generate a sound of a prescribed pitch (hereinafter, at least one (from one to three) string is simply referred to as "the string" for the sake of brevity), a hammer 2 configured to strike the string (sound generating member) 4, a hammer action mechanism 3 configured to move the hammer 2 in accordance with depression of the associated key 1 so as to permit the hammer 2 to strike the string (sound generating member) 4, a solenoid 50 configured to drive the associated key 1 according to performance instruction data so as to cause an action of the key 1 similar to an action caused when the key 1 is actually depressed, and a key sensor 26 configured to measure a position of the key 1 in the vertical direction.

The automatic playing piano 100 further has, for each of the keys 1 except for a predetermined number of the keys 1 in the treble range, a damper 6 configured to be pushed and pressed by the gravity onto the associated string (sound generating member) 4 so as to suppress the vibration of the string (sound generating member) 4 for sound silencing, and a damper mechanism 9 configured to move the damper 6 according to depression of the associated key 1 so as to release the damper 6 from the string 4 (sound generating member).

The automatic playing piano 100 further has: a plate-like key bed 5 on which the keys 1, etc., are placed; a box-like casing 51 which is disposed in a through-hole formed through the key bed 5 in the vertical direction and in which all of the solenoids 50 are accommodated, the longitudinal direction of the casing 51 coinciding with the left-and-right direction; a cover 52 which covers the lower surface of the through-hole in which the casing 51 is accommodated; a bar-like lifting rail 8 which is disposed below the damper mechanisms 9 for pushing up all of the dampers 6 simultaneously and whose longitudinal direction coincides with the left-and-right direction; and a lifting mechanism 11 configured to push up the lifting rail 8 in accordance with depression of the damper pedal 110 by the player.

Each damper mechanism 9 includes a damper lever 91 and a damper wire 92 by which the damper 6 and the damper lever 91 are connected in the vertical direction. The damper lever 91 is pivotally fixed, at a vicinity of a rear-side end portion thereof by a pin 93. The damper lever 91 is connected, at a vicinity of a front-side end portion thereof, to the damper wire 92 via an adjuster to adjust the length of the damper wire 92.

Below the front-side end portion of the damper lever 91, a rear-side end portion of the associated key 1 is situated. In accordance with depression of the key 1 by the player or the solenoid 50, the rear-side end portion of the key 1 pushes up the front-side end portion of the damper lever 91 from below. When the damper lever 91 is pushed up, the damper 6 is pushed up via the damper wire 92. As a result, the damper 6 is moved upward so as to be separated away from the associated string (sound generating member) 4.

When the key 1 is released from the depressed state and returns to a prescribed position (position shown in FIG. 2) by gravity, the damper mechanism 9 and the damper 6 also return to respective prescribed positions (respective positions shown in FIG. 2). As a result, the damper 6 comes into pressing contact with the string (sound generating member) 4 for sound silencing.

The lifting mechanism 11 include& a pedal rod 116 disposed such that the pedal rod 116 is connected to the damper pedal 110 so as to extend upward from a rear-side end portion of the damper pedal 110 and such that an upper end portion of the pedal rod 116 contacts a front-side end portion of a loud lever 117 from below; the loud lever 117 pivotally fixed, at the rear-side end portion thereof, by a phi 113; a damper lifting rod 115 disposed such that its lower end portion is connected to the loud lever 117 at a middle position of the loud lever 17 in the front-and-rear direction and such that its upper end portion contacts the lower surface of the lifting rail 8 from below; and a spring 114 disposed between the loud lever 117 and the cover 52 and configured to push the loud lever 117 downward, i.e., in a clockwise direction in FIG. 2, such that the loud lever 117 pivots downward about the pin 113.

In a state in which the player does not depress a front-side end portion of the damper pedal 110, the pedal rod 116, the loud lever 117, and the damper lifting rod 115 are being pushed downward by the spring 114. In this state, the lifting rail 8 is located at a prescribed lower position (position shown in FIG. 2) without being pushed up by the damper lifting rod 115. Accordingly, the dampers 6 corresponding to the keys 1 which are not in the depressed state press the associated strings 4 (sound generating members) from above.

When the player depresses the front-side end portion of the damper pedal 110 against the force of the spring 114, the pedal rod 116 connected to the rear-side end portion of the damper pedal 110 is pushed up, whereby the loud lever 117, in which the upper end portion of the pedal rod 116 is in abutting contact with the lower surface of the loud lever 117, pivots about the pin 113 upward, i.e., in a counterclockwise direction in FIG. 2. In association with the pivotal movement of the loud lever 117, the damper lifting rod 115 is pushed up, whereby the lifting rail 8, in which the upper end portion of the damper lifting rod 115 is in abutting contact with the lower surface of the lifting rail 8, is pushed up. When the lifting rail 8 is pushed up, all of the damper levers 91 located above the lifting rail 8 pivot about the pins 93 upward, i.e., in the counterclockwise direction in FIG. 2. In association with the pivotal movements of the damper levers 91, the associated dampers 6 are lifted up via the associated damper wires 92. As a result, all of the dampers 6 are moved upward so as to be separated away from the associated strings (sound generating members) 4.

When the player releases the damper pedal 110, the pedal rod 116, the loud lever 117, and the damper lifting rod 115 return back to the respective prescribed positions shown in FIG. 2 by the force of the spring 114, and the lifting rail 8 returns back to the prescribed position shown in FIG. 2 by gravity. As a result, all of the damper mechanisms 9 and the dampers 6 corresponding to non-depressed keys 1 return back to the respective prescribed positions shown in FIG. 2 by gravity, so that the dampers 6 press the associated strings (sound generating members) 4 to silence the sounds.

As explained above, the automatic playing piano 100 has a mechanism in which all of the dampers 6 are forcibly separated away from the associated strings (sound generating members) 4 by pushing up the lifting rail 8 via the lifting mechanism 11 when the player depresses the damper pedal 110. In addition, the automatic playing piano 100 has a mechanism in which all of the dampers 6 are forcibly separated away from the associated strings (sound generating members) 4 by directly pushing up the lifting rail 8 without using the lifting mechanism 11. The latter (additional) mechanism will be hereinafter explained.

Figure 3:
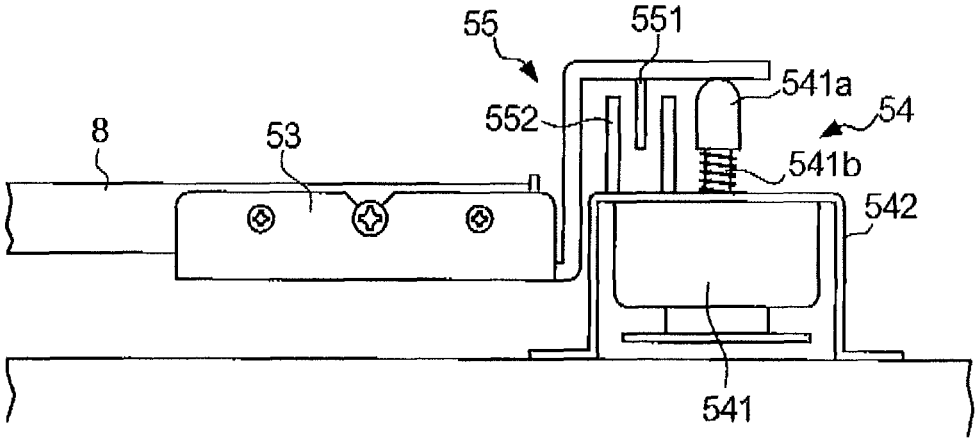
FIG. 3 is a schematic view sowing a lifting rail, a connection member, and a rail drive portion according to the embodiment of the present invention.

FIG. 3 is a schematic view as seen from the front side, showing a right-side end portion of the lifting rail 8 of the automatic playing piano 100, a connection member 53 connected to the lifting rail 8 by screwing, a rail drive portion 54, as a movement-force giving mechanism, configured to push up the lifting rail 8 via the connection member 53 according to signals inputted thereto in accordance with performance instruction data, and a rail sensor 55 configured to measure the position of the lifting rail 8 in the vertical direction. The multiplicity of damper levers 91 which correspond to the keys 1 are arranged in an orderly manner on the upper surface of the lifting rail 8.

The rail drive portion 54 includes a solenoid 541 and a frame 542 to which the solenoid 541 is fixed.

The solenoid 541 includes a plunger 541*a* configured to move upward in accordance with signals externally inputted as the electric current and a spring 541*b* which pushes the plunger 541*a* upward such that the plunger 541*a* is held in slight abutting contact with the connection member 53.

In a state in which no electric current is supplied to the solenoid 541, the plunger 541*a* is located at a prescribed lower position by being pushed downward by gravity of the lifting rail 8, etc. When an electric current is supplied to the solenoid 541, the plunger 541*a* moves upward against the gravity owing to the Coulomb force generated by a coil of the solenoid 541.

When the plunger 541*a* moves upward by the Coulomb force, the plunger 541*a* pushes up the lifting rail 8 via the connection member 53 with which the upper end portion of the plunger 541*a* is held in abutting contact. As a result, all of the dampers 6 are lifted up via the respective damper mechanisms 9, so that the dampers 6 are separated away from the associated strings (sound generating members) 4.

The frame 542 is a strip-like metal member bent into a generally inverted U-letter shape and is fixed to the key bed 5 by screwing, for instance. There is formed, at a central position of an upper wall of the frame 542, a circular through-hole having a predetermined size through which the upper end portion of the plunger 541*a* is movable in the vertical direction. The solenoid 541 is attached to a lower surface of the upper wall of the frame 542 by screwing, for instance.

The rail sensor 55 includes: a light transmission plate 551 attached to the connection member 53 so as to extend downward from a prescribed position of the connection member 53; and a detecting portion 552. The light transmission plate 551 is a plate-like member formed of synthetic resin, for instance, and is processed such that an amount of the light that passes therethrough varies depending upon positions in the vertical direction. The detecting portion 552 is a photo sensor having a light emission portion and a light receive portion. The light emitted from the light emission portion passes through the light transmission plate 551 and is received by the light receive portion. The detecting portion 552 is configured to output a signal in accordance with the amount of the received light. In this arrangement, the signal outputted from the detecting portion 552 indicates the position of the lifting rail 8 in the vertical direction.

Figure 4:
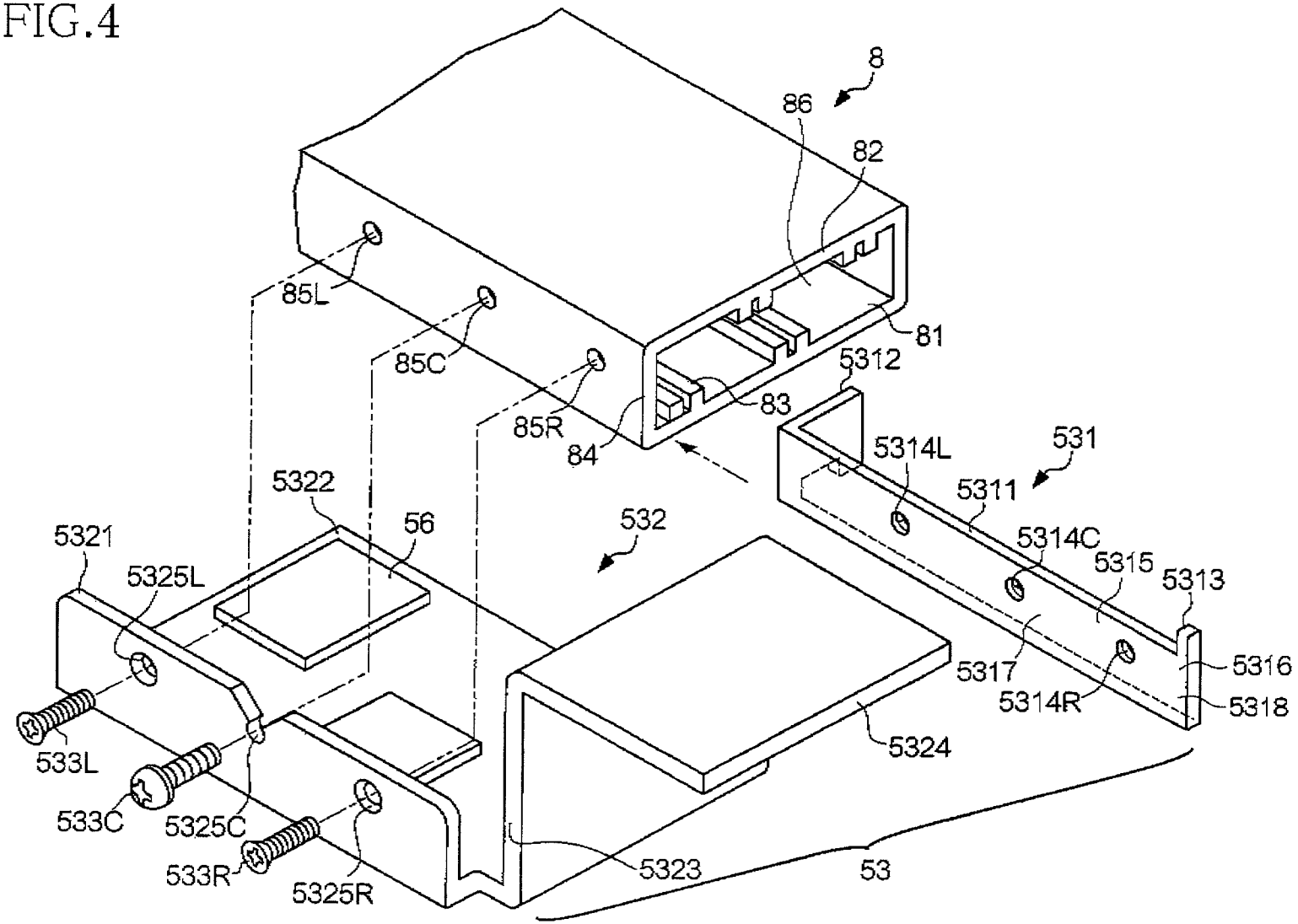
FIG. 4 is a schematic view showing structures of the lilting rail and the connection member according to the embodiment of the present invention.

FIG. 4 is a schematic view showing the structure of the connection member 53 and the structure of the vicinity of the right-side end portion of the lifting rail 8 to which the connection member 53 is to be connected. FIG. 4 also shows a plurality of cushioning members 56 which are elastic members and which are disposed between the connection member 53 and the lifting rail 8 when the connection member 53 is connected to the lifting rail 8.

As shown in FIG. 4, the lifting rail 8 is a hollow pipe-like member having a rectangular cross-sectional shape. Each of a lower wall portion 81 and an upper wall portion 82 of the lifting rail 8 is provided with a plurality of ridge portions 83 each of which protrudes inward from the corresponding wall portion 81, 82 so as to extend along a longitudinal direction of the lifting rail 8. The ridge portions 83 are for ensuring adequate strength of the lifting rail 8.

In a front-side wall portion 84 of the lifting rail 8 located in the vicinity of the right-side end portion of the same 8, three through-holes 85 are formed through the thickness of the front-side wall portion 84 in the horizontal direction. Where it is necessary to distinguish the three through-holes 85 from one another, the three through-holes 85 are respectively referred to as a through-hole 85L, a through-hole 85C, and a through-hole 85R in order from the left.

The connection member 53 includes: a first member 531 (as one example of an insertion member) disposed such that a substantial part of the first member 531 is inserted in a hollow portion 86 of the lifting rail 8 and such that the first member 531 comes into contact with an inner surface of the front-side wall, portion 84 of the lifting rail 8; a second member 532 disposed such that the second member 532 comes into contact with outer surfaces of the respective front-side wall portion 84 and the lower wall portion 81 of the lifting rail 8; and three screws 533 (each as one example of a fixing member) for connecting the connection member 53 to the lifting rail 8. Here, the lifting rail 8 needs to be open at one end thereof in the longitudinal direction, and the other end of the lifting rail 8 in the longitudinal direction may be open or may be closed.

Where it is necessary to distinguish the three screws 533 from one another, the three screws 533 are respectively referred to as a screw 533L, a screw 533C, and a screw 533R in order from the left in accordance with respective positions when attached to the connection members 53 and the lifting rail 8. Each of the screw 533L and the screw 533R is a countersunk head screw while the screw 5330 is a truss head screw.

The first member 531 has: a front-side wall portion 5311 which is to come into contact with the inner surface of the front-side wall portion 84 of the lifting rail 8; and a leg portion 5312 which extends from a left-side end portion of the front-side wall portion 5311 toward the rear side so as to form an angle of 90° with respect to the front-side wall portion 5311. The leg portion 5312 is for supporting the first member 531 such that the first member 531 does not fall down. In other words, the leg portion 5312 is held in contact with the lower wall portion 81 in a state in which the first member 531 is inserted in the hollow portion 86 of the lifting rail 8, thereby preventing the first member 531 from rotating about an axis that is parallel the left-and-right direction which coincides with the longitudinal direction of the lifting rail 8. Thus, the leg portion 5312 functions as a rotation preventive portion. The leg portion 5312 has a cutout for permitting the ridge portions 83 formed on the lower wall portion 81 to pass therethrough.

The first member 531 further has a protruding portion 5313 (as one example of a contact portion) which protrudes upward from a right-side end portion of the front-side wall portion 5311. The protruding portion 5313 is configured to come into contact with a right-side end face of the lifting rail 8 when the first member 631 is inserted in the hollow portion 86 of the lifting rail 8 in the longitudinal direction, thereby facilitating positioning of the first member 531 in the left-and-right direction relative to the lifting rail 8.

In the front-side wall portion 5311 of the first member 531, three threaded holes 5314 (each as one example of an attachment hole) are formed through the thickness of the front-side wall portion 5311 in the horizontal direction. Into the three threaded holes 5314, the three screws 533 indicated above are respectively screwed. The inner circumferential surface of each threaded hole 5314 is formed with thread grooves. The threaded grooves are formed at a pitch and have a depth corresponding to thread ridges formed on the outer circumferential surface of each of the screws 533. Where it is necessary to distinguish the three threaded holes 5314 from one another, the three threaded holes 5314 are respectively referred to as a threaded hole 5314L, a threaded hole 5314C, and a threaded hole 5314R in order from the left. In the first member 531, a portion which is inserted in the hollow portion 86 of the lifting rail 8 is an internal portion 5315, and a portion which is formed integrally with the internal portion 5315 by one plate and which is not inserted in the hollow portion 86 (i.e., a portion of the first member 531 which is disposed outside the lifting rail 8) is an external portion 5316. A surface 5317 of the internal portion 5315 of the front-side wall portion 5311 contacts the inner surface of the front-side wall portion 84 of the lifting rail 8. A surface 5318 of the external portion 5316 of the front-side wall portion 5311 is formed on the same plane as the surface 5317 and is a contiguous surface which is contiguous to the surface 5317. The protruding portion 5313 is a part of the external portion 5316 and extends on one side (the upper side) of the first member 531 which is opposite to the other side (the lower side) of the first member 531 on which the cushioning members 56 are disposed. That is, the protruding portion 5313 is formed integrally with the internal portion 5315 disposed in the hollow portion 86 of the lifting rail 8, such that the protruding portion 5313 extends upwardly with respect to the upper wall portion 82 of the lifting rail 8, in other words, the top end of the protruding portion 5313 is located at a height position higher than the upper wall portion 82, in a state in which the first member 531 is inserted in the hollow portion 86.

The second member 532 has: a front-side wall portion 5321 (as one example of a fixation portion) which is to come into contact with the outer surface of the front-side wall portion 84 of the lifting rail 8; a lower wall portion 5322 which extends from a lower end portion of the front-side wall portion 5321 toward the rear side so as to form an angle of 90° with respect to the front-side wall portion 5321 and which is to come into contact with the outer surface of the lower wall portion 81 of the lifting rail 8; a right-side wall portion 5323 which extends upward from a right-side end portion of the lower wall portion 5322 so as to form an angle of 90° with respect to the lower wall portion 5322 and which is disposed so as to cover the right-side end face of the lifting rail 8; and a force receive portion 5324 which extends rightward integrally from an upper-side end face of the right-side wall portion 5323 so as to form an angle of 90° with respect to the right-side wall portion 5323 and which is configured to receive a force from the plunger 541*a* of the rail drive portion 54. It is noted that the light transmission plate 551 is attached to the lower surface of the force receive portion 5324, as shown in FIG. 3.

In the front-side wall portion 5321 of the second member 532, three through-holes 5325 (each as one example of an attachment hole) are formed through the thickness of the front-side wall portion 5321 in the of horizontal direction. Into the three through-holes 5325, the three screws 533 described above are respectively inserted. Where it is necessary to distinguish the three through-holes 5325 from one another, three through-holes 5325 are respectively referred to as a through-hole 5325L, a through-hole 5325C, and a through-hole 5325R in order from the left. The through-hole 5325L and the through-hole 5325R are subjected to countersinking processing. The through-hole 5325C is contiguous to a cutout which is formed at the upper end of the front-side wall portion 5321 so as to be continuous to the through-hole 5325C. Accordingly, the through-hole 5325C is open upward.

A connection work for connecting the connection member 53 to the lifting rail 8 is conducted as follows, for instance. Initially, a worker places the cushioning members 56 at respective predetermined positions on the upper surface of the lower wall portion 5322 of the second member 532. On this occasion, the cushioning members 56 may be bonded to the lower wall portion 5322 by an adhesive or the like to prevent the cushioning members 56 from being moved or shifted from the predetermined positions in the connection work.

Subsequently, the worker inserts the first member 531 into the hollow portion 86 of the lifting rail 8. On this occasion, the first member 531 is positioned relative to the lifting rail 8 such that the front surface of the front-side wall portion 5311 of the first member 531 comes into contact with the inner surface of the front-side wall portion 84 of the lifting rail 8 and such that the protruding portion 5313 of the first member 531 comes into contact with the right-side end face of the lifting rail 8.

The leg portion 5312 extends from the front-side wall portion 5311 of the first member 531 toward the rear side and is configured to come into contact with the lower wall portion 81 at a position at which the leg portion 5312 is spaced apart from the front-side wall portion 84 of the lifting rail 8 toward the rear side by a certain distance. Accordingly, the first member 531 stands on its own while being supported by the leg portion 5312, so that the first member 531 does not fall down in the lifting rail 8. Further, the front part of the lower end portion of the first member 531 is sandwiched by and between the front-side wall portion 84 and the most frontward one of the ridge portions 83 formed on the inner surface of the lower wall portion 81 of the lifting rail 8. Accordingly, in the following screwing work of the screws 533, it is possible to prevent the first member 531 from being pushed by the screws 533 and moved toward the rear side in the lifting rail 8.

When the first member 531 is disposed at the prescribed position in the lifting rail 8 as described above, the through-holes 85 of the lifting rail 8 are brought into communication with the corresponding three threaded holes 5314 of the first member 531.

Thereafter, the worker inserts the screw 5330 into the through-hole 85C of the lifting rail 8 and the threaded hole 5314C communicating with the through-hole 85C, and then screws the screw 533C into the threaded hole 5314C. On this occasion, the worker suspends screwing at a position at which a distance between the head of the screw 633C and the front-side wall portion 84 of the lifting rail 8 is slightly larger than the thickness of the front-side wall portion 5321 of the second member 532.

Subsequently, the worker attaches the second member 532 on which the cushioning members 56 have been placed or bonded, to the lower surface of the lifting rail 8, such that the screw 5330 is fitted into the through-hole 5325C of the second member 532, and thereafter screws the screw 533C further into the through-hole 5325C so as to temporarily fix the second member 532 to the lifting rail 8.

When the second member 532 is temporarily fixed to the lifting rail 8 by the screw 5330, the through-hole 5325L and the through-hole 5325R of the second member 532 are respectively brought into communication with the through-hole 85L and the through-hole 85R of the lifting rail 8; and the threaded hole 5314L and the threaded hole 5314R of the first member 531 which are respectively in communication with the through-hole 85L and the through-hole 85R.

Next, the worker inserts the screw 533L into the through-hole 5325L, the through-hole 85L, and the threaded hole 5314L which are held in communication with one another, and tightly screws the screw 533L into the threaded hole 5314L. Similarly, the worker inserts the screw 533R into the through-hole 5325R, the through-hole 85R, and the threaded hole 5314R which are held in communication with one another, and tightly screws the screw 533R into the threaded hole 5314R. Thereafter, the worker tightly screws the screw 5330 which has been temporarily fixed, into the threaded hole 5314C.

When the screw 533L is tightly screwed into the threaded hole 5314L, the center of the through-hole 5325L and the centers of the through-hole 85L and the threaded hole 5314L align with each other. Similarly, when the screw 533R is tightly screwed into the threaded hole 5314R, the center of the through-hole 5325R and the centers of the through-hole 85R and the threaded hole 5314R align with each other. In the present embodiment, the positions of the through-holes and the threaded holes are determined such that the dimension of a spacing (distance) between the lower wall portion 5322 of the second member 532 and the lower wall portion 81 of the lifting rail 8 is equal to 1.2 mm, for instance, in a state in which the center of the through-hole 5325L and the centers of the through-hole 85L and the threaded hole 5314L align with each other and the center of the through-hole 5325R and the centers of the through-hole 85R and the threaded hole 5314R align with each other as described above. On the other hand, the thickness of each of the cushioning members 56 disposed between the lower wall portion 5322 of the second member 532 and the lower wall portion 81 of the lifting rail 8 is equal to 1.4 mm, for instance. In a state in which the screw 533L and the screw 533R are tightly screwed into the threaded hole 5314L and the threaded hole 5314R, respectively, the inner surface of the front-side wall portion 84 of the lifting rail 8 and the surface 5317 of the first member 531 are held in surface contact with each other. Similarly, in that state, the outer surface of the front-side wall portion 84 of the lifting rail 8 is held in surface contact with the inner surface of the front-side wall portion 5321 of the second member 532.

As described above, in a state in which the second member 532 is attached to the lifting rail 8, the dimension of the spacing (distance) between the lifting rail 8 and the second member 532 is adjusted so as to be smaller than the original thickness of each cushioning member 56, whereby the so-called rattling does not occur between the lifting rail 8 and the second member 532 owing to the restoring force of the compressed cushioning members 56, ensuring secure fixation of the second member 532 to the lifting rail 8.

Figure 5:
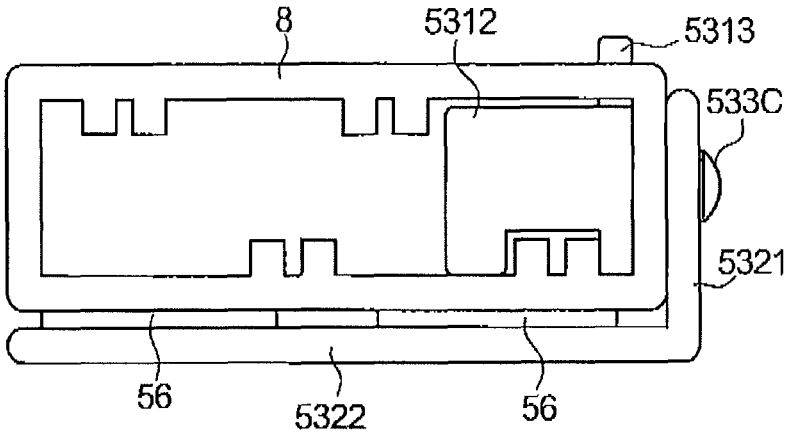
FIG. 5 is a schematic view showing a connected state of the lifting rail and the connection member according to the embodiment of the present invention.

Thus, the connection work for connecting the connection member 53 to the lifting rail 8 is completed. FIG. 5 is a schematic view showing the lifting rail 8, the connection member 53, and the cushioning member 56 after completion of the connection work, as viewed from the left side.

There will be next explained an electric structure of the automatic playing piano 100. The automatic playing piano 100 has a controller 10 configured to control the above-indicated solenoids 50 and solenoid 541 for automatic performance.

Figure 6:
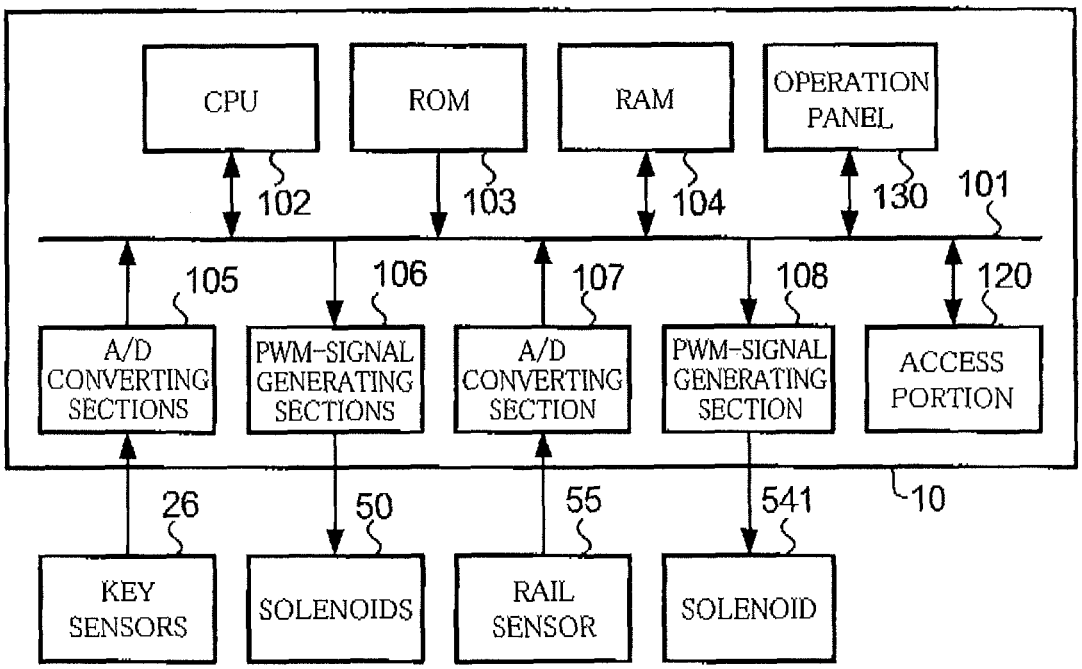
FIG. 6 is a block diagram showing a structure of a controller according to the embodiment of the present invention.

FIG. 6 is a block diagram showing the structure of the controller 10. The controller 10 includes a CPU (Central Processing Unit) 102, a ROM (Read Only Memory) 103, a RAM (Random Access Memory) 104, A/D converting sections 105, PWM-signal generating sections 106, an A/D converting section 107, and a PWM-signal generating section 108. The controller 10 further includes the access portion 120 and the operation panel 130 described above. Those functional sections are connected to one another via a bus 101.

The A/D converting section 105 and the PWM-signal generating section 106 are provided for each of all keys 1 and serve as functional sections for controlling the position of the associated key 1. On the other hand, since the A/D converting section 107 and the PWM-signal generating section 108 are functional sections for controlling the position of the lifting rail 8, only one A/D converting section 105 and only one PWM-signal generating section 106 are provided.

The CPU 102 is configured to read performance instruction data from a recording medium inserted in the access portion 120 according to the control program stored in the ROM 103 utilizing the RAM 104 as a work area and to drivingly control the solenoids 50 and the solenoid 541 according to the read performance instruction data, thereby executing automatic performance. The CPU 102 functions as a performance-instruction-data obtaining section.

Figure 7:
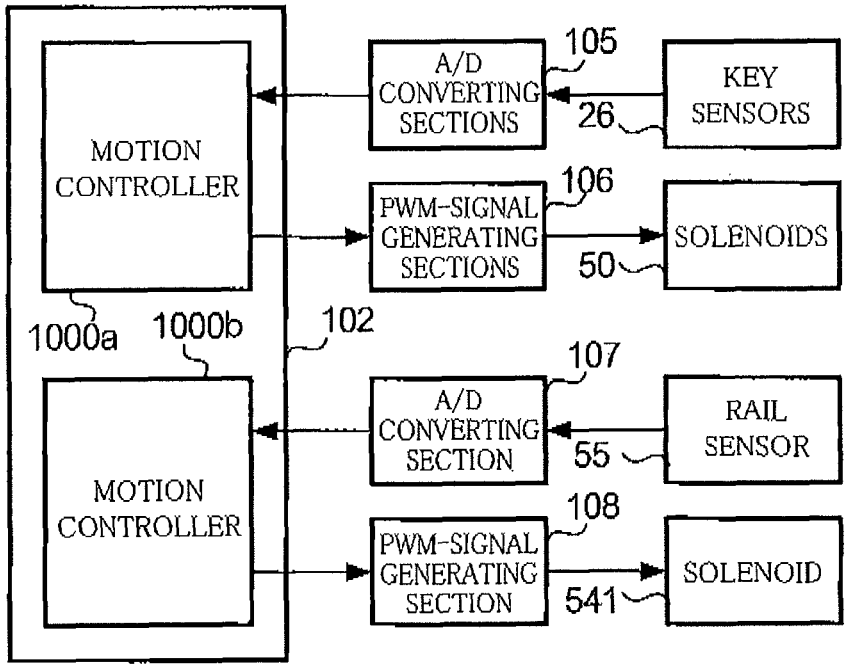
FIG. 7 is a block diagram showing a functional structure of the controller according to the embodiment of the present invention.

FIG. 7 is a block diagram showing the functional structure of the controller 10 for automatic performance. The CPU 102 functions as a motion controller 1000*a* and a motion controller 1000*b* by executing processing according to the control program.

The motion controller 1000*a* controls movements of the keys 1. The motion controller 1000*a* is configured to generate trajectory data that indicates which keys 1 should be located at which positions at what timing, on the basis of note-on data and note-off data contained in the performance instruction data of the MIDI format obtained from the recording medium.

On the other hand, each A/D converting section 105 is configured to convert an analog signal outputted from the associated key sensor 26 into a digital signal and to output the digital signal after conversion, to the motion controller 1000*a*.

The motion controller 1000*a* is configured to execute a servo control for each of the keys 1, such that a position at which the key 1 should be currently located and which is indicated by the generated trajectory data coincides with a current position of the key 1 indicated by the signal inputted thereto from the All) converting section 105. The motion controller 1000*a* outputs, to the PWM-signal generating section 106*a*, a drive signal indicative of a drive force in accordance with a speed to be required for the movement of the key 1.

The PWM-signal generating section 106 is configured to convert the drive signal inputted thereto from the motion controller 1000*a* into a PWM signal of a PWM (Pulse Width Modulation) format and to output the PWM signal to the solenoid 50 of the associated key 1. The solenoid 50 displaces the corresponding plunger according to the PWM signal inputted thereto from the PWM-signal generating section 106. As a result, the key 1 is depressed by the solenoid 50 according to the performance instruction data.

The motion controller 1000*b* controls the movement of the lifting rail 8. The motion controller 1000*b* is configured to generate trajectory data that indicates at which position the lifting rail 8 should be located at what timing, on the basis of control change data indicative of a position of the damper pedal contained in the performance instruction data of the MIDI format obtained from the recording medium.

On the other hand, the A/D converting section 107 is configured to convert an analog signal outputted from the rail sensor 55 into a digital signal and to output the digital signal after conversion, to the motion controller 1000*b*.

The motion controller 1000*b* is configured to execute a servo control, such that a position at which the lifting rail 8 is currently located and which is indicated by the generated trajectory data coincides with a current position of the lifting rail 8 indicated by the signal inputted thereto from the A/D converting section 107 coincide with each other. The motion controller 1000*b* outputs, to the PWM-signal generating section 108, a drive signal indicative of a drive force in accordance with a speed to be required for the movement of the lifting rail 8. The motion controller 1000*b* and the PWM-signal generating section 108 function as a signal generating section.

The PWM-signal generating section 108 is configured to convert the drive signal inputted thereto from the motion controller 1000*b* into a PWM signal and to output the PWM signal to the solenoid 541. The solenoid 541 displaces the plunger 541*a* according to the PWM signal inputted thereto from the PWM-signal generating section 108. As a result, the lifting rail 8 is pushed up by the solenoid 541 according to the performance instruction data.

In the manner described above, the keys 1 are driven by the solenoids 50 and the lifting rail 8 is driven by the solenoid 541 under the control of the controller 10, whereby automatic performance involving the loud effect is realized.

According to the automatic playing piano 100 described above, in automatic performance, the lifting rail 8 is directly driven by the solenoid 541 via the connection member 53 connected directly to the lifting rail 8, for forcibly releasing all of the dampers 6 simultaneously from the associated strings 4. Consequently, as compared with an arrangement in which the lifting rail 8 is indirectly driven via the lifting mechanism 11, for instance, it is possible to reduce the drive force required for driving the lifting rail 8 and to reduce the noise generated by driving of the lifting rail 8.

In the automatic playing piano 100, the front-side wall portion 84 of the lifting rail 8 is sandwiched by and between the first member 531 and the second member 532 as described above. Therefore, even where the lifting rail 8 is formed of a material with relatively low hardness such as aluminum, sufficiently strong connection between the connection member 53 and the lifting rail 8 is ensured without a fear of damaging the lifting rail 8 when the connection member 53 is attached to the lifting rail 8.

For ensuring such connection, it is required to perform the screwing work with respect to the first member 531 inserted in the hollow portion 86 of the lifting rail 8. In general, in an instance where an inner member to be inserted in a pipe-like member is formed with a threaded hole and a screw is fitted into the threaded hole from an outer side of the pipe-like member, it is difficult to perform positioning of the threaded hole of the inner member relative to a through-hole formed in the pipe-like member. Further, when the screw is pushed into the threaded hole of the inner member, there may be a risk that the inner member having the threaded hole moves in the pipe-like member and sometimes falls down. Hence, the screw fastening work involves difficulty.

In contrast, according to the connection member 53 employed in the automatic playing piano 100, the positioning of the first member 531 relative to the lifting rail 8 is easy owing to the protruding portion 5313, and there is not risk that the first member 531 falls down in the lifting rail 8, owing to the leg portion 5312. Therefore, the present automatic playing piano 100 do not suffer from the problems described above. Further, the leg portion 5312 has the cutout in which the ridge portions 83 are accommodated, namely, the leg portion 5312 straddles the ridge portions 83. Accordingly, even where the first member 531 receives, from the screw 533C, a force in a direction from the front side to the rear side when the first member 531 is temporarily fixed to the lifting rail 8 by the screw 5330, the ridge portions 83 can receive the force. Therefore, the first member 531 is prevented from moving toward the rear side in the hollow portion 86 of the lifting rail 8. Accordingly, it is possible to enhance the working efficiency in connecting the connection member 53 to the lifting rail 8.

Further, in the present automatic playing piano 100, the dimension of the spacing (distance) formed between the lifting rail 8 and the connection member 53 in a state in which the connection member 53 is connected to the lifting rail 8 is adjusted to be smaller than the thickness of each of the cushioning members 56 disposed in the spacing. Accordingly, more secure connection of the connection member 53 with respect to the lifting rail 8 is ensured.

Moreover, since the protruding portion 5313 is formed integrally with the internal portion 5315 of the first member 531, it is possible to enhance the positioning accuracy of the connection member 53 relative to the lifting rail 8, as compared with an arrangement in which the protruding portion 5313 is formed separately or independently from the internal portion 5315. Further, since the external portion 5316 including the protruding portion 5313 is formed on the same plane as the internal portion 5315, the position of the protruding portion 5313 relative to the internal portion 5315 is more accurate and it is possible to ensure a higher degree of positioning accuracy of the connection member 53 relative to the lifting rail 8, as compared with an arrangement in which the protruding portion 5313 is formed by bending work. In addition, since the protruding portion 5313 is provided so as to protrude on the upper side of the lifting rail 8 opposite to the lower side of the same 8 on which the cushioning members 56 are disposed, the protruding portion 5313 can be made so as to have a desired size that does not depend on the size of the spacing between the lifting rail 8 and the connection member 53. Further, since the first member 531 and the second member 532 are separate from and independent of each other, the first member 531 can be easily inserted into the lifting rail 8.

Modified Embodiment

While one embodiment of the present invention has been described above, it is to be understood that the present invention is not limited to the details of the illustrated embodiment, but may be embodied with various other changes and modifications without departing from the scope of the invention defined in the attached claims. Hereinafter, modified embodiments will be explained.

In the illustrated embodiment, the connection member 53 is constituted by the first member 531 and the second member 532 which are separate members. The connection member 53 may be constituted by the first member 531 and the second member 532 which are connected to each other.

In the illustrated embodiment, there is employed a structure in which the lifting rail 8 is sandwiched by the first member 531 and the second member 532, such that the first member 531 disposed inside the lifting rail 8 and the second member 532 disposed outside the lifting rail 8 are fastened using the screws 533. There may be employed other structure in which the lifting rail 8 is sandwiched by the heads of the screws and an insertion member which is a portion of the connection member inserted in the hollow portion 86 of the lifting rail 8, without providing, in the connection member, a member disposed outside the front-side wall portion 84 of the lifting rail 8, as described below.

Figure 8:
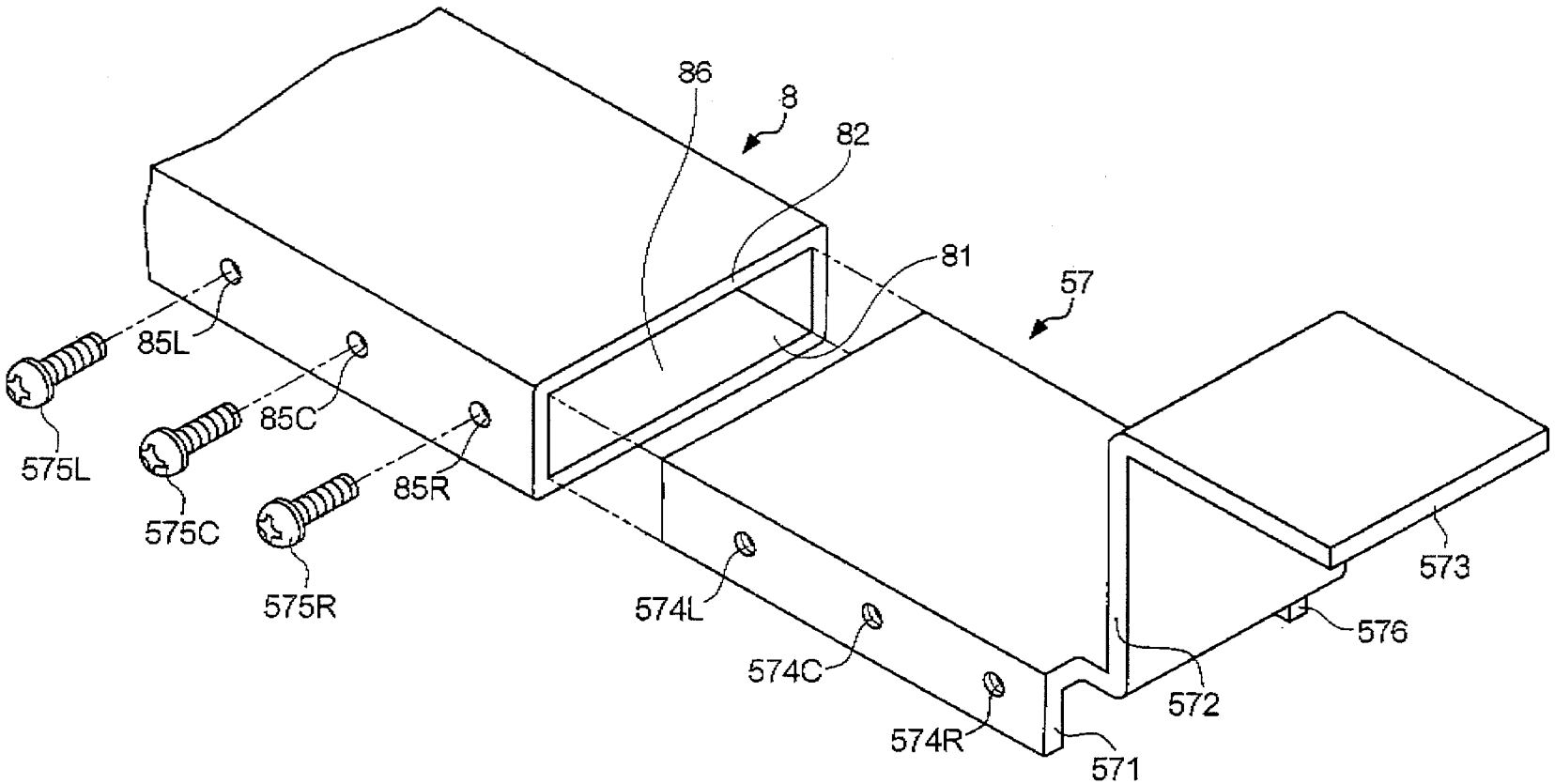
FIG. 8 is a schematic view showing a structure of a connection member according to a modified embodiment of the present invention.

FIG. 8 is a view schematically showing a structure of a connection member 57 as one example of the connection member having the structure indicated above. The connection member 57 includes: an insertion member 571 (as one example of an internal portion) which has an inverted U-letter shape and which is a portion of the connection member 57 to be inserted in the hollow portion 86 of the lifting rail 8; a right-side wall portion 572 (as one example of an external portion) which is a portion of the connection member 57 not to be inserted in the hollow portion 86 of the lifting rail 8 and which extends upward from a right-side upper end face of the insertion member 571; a force receive portion 573 which is a portion of the connection member 57 not to be inserted in the hollow portion 86 of the lifting rail 8 and which extends from rightward from a right-side upper end face of the right-side wall portion 572; and screws 575L, 575C, 575R (each as one example of a fixing member) which are to be screwed into threaded holes 574L, 574, 574R (each as one example of an attachment hole) which are formed in the front-side wall portion of the insertion member 571 in this order from the left side. Each of the screws 575L, 575C, 575R is a truss head screw. The insertion member 571, the right-side wall portion 572, and the force receive portion 573 are formed integrally with each other by one plate. The right-side wall portion 572 is formed between the insertion member 571 and the force receive portion 573.

The shape and the size of the insertion member 571 are adjusted such that the insertion member 571 fits to the inside of the lifting rail 8. The insertion member 571 is inserted in the hollow portion 86 of the lifting rail 8. A rear-side wall portion 576, which is a portion of the insertion member 571 and which is formed integrally with a front-side wall portion and an upper wall portion of the insertion member 571, comes into contact with the lower wall portion 81 of the lifting rail 8 on the front side of the rear-side wall portion of the lifting rail 8. In a state in which the insertion member 571 is inserted in the lifting rail 8, a left-side end face of the right-side wall portion 572 (as one example of a contact portion) contacts the right-side end face of the lifting rail 8, whereby the connection member 57 is positioned relative to the lifting rail 8 in the left-and-right direction. When the connection member 57 is thus positioned relative to the lifting rail 8, the through-hole 85L, the through-hole 85C, and the through-hole 85R of the lifting rail 8 are respectively brought into communication with the threaded hole 574L, the threaded hole 574C, and the threaded hole 574R of the connection member 57. Subsequently, the worker inserts the screws 575 into the through-holes 85 and the threaded holes 574 that are held in communication with one another, and the screws 575 are then screwed into and fastened with respect to the threaded holes 574.

In the modified embodiment shown in FIG. 8, no cushioning members are used in connecting the connection member 57 to the lifting rail 8. The cushioning members may be used in the modified embodiment. In this instance, the cushioning members may be disposed between the upper surface of the insertion member 571 and the lower surface of the upper wall portion 82 of the lifting rail 8, for instance. Where the cushioning members are thus disposed, it is preferable to adjust the positions of the through-holes 85 and the threaded holes 574 such that there is formed, between the insertion member 571 and the upper wall portion 82 of the lifting rail 8, a spacing whose dimension in the vertical direction is smaller than the original thickness of the cushioning members, as in the illustrated embodiment.

As explained above, the connection member 57 also ensures easy connection work with respect to the lifting rail 8.

The connection member 57 is constituted such that the insertion member 571 to be inserted in the lifting rail 8, the right-side wall portion 572, and the force receive portion 573 are integral with each other, whereby processing of the connection member 57 is facilitated. In a state in which the connection member 57 is inserted in the lifting rail 8, the rear-side wall portion 576 of the insertion member 571 is held in contact with the lower wall portion 81 of the lifting rail 8, whereby the connection member 57 is prevented from falling down in the lifting rail 8. In this respect, the rear-side wall portion 576 functions as a rotation preventive portion.

In the illustrated embodiment, the thread grooves of each threaded hole 5314 are formed on the inner circumferential surface of the threaded hole 5314. As long as each screw 533 can be fastened with respect to the first member 531 by screwing, the shape of the threaded hole 5314 and the position at which the thread grooves are formed are not particularly limited.

Figure 9A:
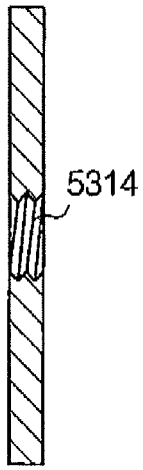
FIG. 9A is a schematic view showing a structure of a threaded hole according to the embodiment of the present invention and FIG. 9B is a schematic view showing a structure of a threaded hole according to a modified embodiment of the present invention.
Figure 9B:
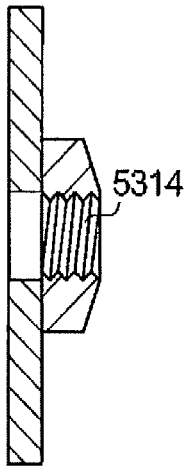

Referring to FIGS. 9A and 9B, there will be explained a modified structure of the threaded hole 5314. FIG. 9A schematically shows the shape of the threaded hole 5314 and the position of the thread grooves of the threaded hole 5314 in the illustrated embodiment. FIG. 9B schematically shows the shape of the threaded hole 5314 and the position of the thread grooves of the threaded hole 5314 according to the modified structure. The threaded hole 5314 shown in FIG. 913 is constituted by: a nut attached by welding on the rear surface of the front-side wall portion 5311 of the first member 531; and a through-hole formed through the thickness of the front-side wall portion 5311 so as to communicate with a threaded hole of the nut. According to the threaded hole 5314 shown in FIG. 9B, the screws 533 can be fastened by screwing with respect to the first member 531 more securely, as compared with the threaded hole 5314 shown in FIG. 9A.

In the illustrated embodiment, the solenoid type actuator is employed as the actuator for driving the lifting rail 8. There may be employed actuators of other types such as a hydraulic actuator and a motor type actuator.

The solenoid 541 employed in the illustrated embodiment is one example. As the actuator, there may be employed other solenoids such as a solenoid not equipped with the spring 541*b*.

In the illustrated embodiment, the connection member 53 is connected to the right-side end portion of the lifting rail 8. In addition or instead, the connection member 53 may be connected to the left-side end portion of the lifting rail 8. In this instance, the rail drive portion 54 and the rail sensor 55 are disposed also on the left-side end portion of the lifting rail 8.

In the illustrated embodiment, the lifting rail 8 is driven under the servo control. For driving the lifting rail 8, there may be employed an arrangement in which the servo control is not executed, In the illustrated embodiment, as the performance instruction data, the data of the MIDI format is used. The performance instruction data of other format may be used.

In the illustrated embodiment, the screws are used for fixing the connection member 53 or the connection member 57 to the lifting rail. The fixation of the connection member to the lifting rail may be otherwise conducted. For instance, in place of the threaded holes 5314 or the threaded holes 574, there may be formed attachment holes in which no thread grooves are formed. Rivets, each as a fixing member, may be inserted into the through-holes and the attachment holes for fixation. Bolts, each as a fixing member, and nuts may be used for fixation.

In the illustrated embodiment, the piano has been explained as the musical instrument equipped with the damper mechanisms, by way of example. The present invention is applicable to various other musical instruments, such as celesta and glockenspiel, equipped with the damper mechanisms for silencing sounds generated by sound generating members configured to vibrate by being struck. In this instance, the movements of the dampers may be stored as performance data and the dampers may be driven based on the performance data, as in the piano of the illustrated embodiment.

What is claimed is:

1. A drive mechanism of a lifting rail for a musical instrument which comprises: dampers each configured to come into contact with a sound generating member provided for a corresponding one of a plurality of keys for generating a sound of one of a plurality of pitches that are generated by the musical instrument, so as to suppress a vibration of the sound generating member; damper levers each connected to a corresponding one of the dampers directly or indirectly for moving the damper away from the sound generating member in accordance with depression of a corresponding one of the plurality of keys; and a lifting rail having a bar-like configuration and configured to operate all of the damper levers, such that each of the dampers is spaced apart from the sound generating member, the drive mechanism comprising:

a connection member to be connected to one end of the lifting rail; and a movement-force giving mechanism configured to move the lifting rail via the connection member in accordance with a signal to be inputted thereto, wherein the lifting rail includes: a hollow portion which is open at the one end of the lifting rail; and a through-hole which is formed through an upright wall portion of the lifting rail which stands in a vertical direction and which is one of a plurality of wall portions of the lifting rail situated between the hollow portion and an exterior of the lifting rail, wherein the connection member includes: an insertion member in which an attachment hole is formed at a position corresponding to the through-hole and which is to be inserted in the hollow portion of the lifting rail; and a fixing member configured to be inserted into the through-hole and the attachment hole for connecting the lifting rail and the connection member, and wherein the connection member includes a contact portion configured to come into contact with the one end of the lifting rail when the insertion member is inserted in the hollow portion by a prescribed distance so as to prevent the insertion member from being further inserted in the hollow portion, thereby positioning the attachment hole relative to the through-hole.

2. The drive mechanism of the lifting rail according to claim 1, wherein the connection member is connected to the lifting rail in a state in which the insertion member is inserted in the hollow portion and is held in surface contact with an inner surface of the upright wall portion of the lifting rail.

3. The drive mechanism of the lifting rail according to claim 1, wherein the connection member includes: an external portion which is formed integrally with an internal portion of the insertion member and which is not inserted in the hollow portion, the internal portion being to be inserted in the hollow portion of the lifting rail, and wherein the contact portion is formed integrally with the external portion.

4. The drive mechanism of the lifting rail according to claim 3, wherein the external portion includes a contiguous surface which is contiguous to a surface of the internal portion that is to be in contact with an inner surface of the upright wall portion of the lifting rail, and wherein the contact portion is formed along the contiguous surface so as to extend outwardly with respect to at least one horizontal wall portion among the plurality of wall portions of the lifting rail, in a state in which the insertion member is inserted in the hollow portion.

5. The drive mechanism of the lifting rail according to claim 1, wherein the insertion member includes a rotation preventive portion configured to be in contact with an inner surface of at least one wall portion among the plurality of wall portions of the lifting rail in a state in which the insertion member is inserted in the hollow portion of the lifting rail, thereby preventing the insertion member from rotating about an axis that is parallel to a longitudinal direction of the lifting rail.

6. The drive mechanism of the lifting rail according to claim 1, wherein the lifting rail includes at least one ridge portion provided on at least one horizontal wall portion among the plurality of wall portions of the lifting rail, so as to extend in a longitudinal direction of the lifting rail.

7. The drive mechanism of the lifting rail according to claim 1, further comprising at least one cushioning member which is an elastic member and which is disposed between the lifting rail and the connection member in the vertical direction, wherein a position of the through-hole in the lifting rail and a position of the attachment hole in the connection member are determined such that, in a state in which a center position of the through-hole and a center position of the attachment hole are aligned with each other with the insertion member inserted in the hollow portion, a dimension of a spacing in the vertical direction formed between the lifting rail and the connection member at a location at which each of the at least one cushioning member is located is smaller than a dimension of each of the at least one cushioning member in the vertical direction.

8. The drive mechanism of the lifting rail according to claim 7, wherein the connection member includes an external portion which is formed integrally with the insertion member and which is not inserted in the hollow portion, and wherein the contact portion is formed integrally with the external portion and is provided on one side of the connection member in the vertical direction which is opposite to the other side of the connection member in the vertical direction on which each of the at least one cushioning member is disposed.

9. The drive mechanism of the lifting rail according to claim 1, wherein the connection member includes a first member as the insertion member and a second member which is separate from the first member and which is configured to receive a force from the movement-force giving mechanism, and wherein the second member is fixed to the first member and the lifting rail by the fixing member.

10. The drive mechanism of the lifting rail according to claim 9, wherein the insertion member and the contact portion are formed integrally with the first member.

11. The drive mechanism of the lifting rail according to claim 9, wherein the second member is connected to the lifting rail such that a surface of a wall of the second member, in which an attachment hole is formed so as to correspond to the through-hole, is held in surface contact with an outer surface of the upright wall portion of the lifting rail.

12. The drive mechanism of the lifting rail according to claim 9, wherein the second member includes: a fixation portion to be fixed to the lifting rail by the fixing member; and a force receive portion formed integrally with the fixation portion and configured to receive the force from the movement-force giving mechanism.

13. The drive mechanism of the lifting rail according to claim 1, wherein the connection member is formed such that the insertion member and a force receive portion are formed integrally with each other, the force receive portion being configured not to be inserted in the hollow portion and configured to receive a force from the movement-force giving mechanism, and wherein the contact portion is provided between the insertion member and the force receive portion.

14. A musical instrument, comprising:

the drive mechanism of the lifting rail defined in claim 1;

a performance-instruction-data obtaining section configured to obtain performance instruction data which instructs: generation of sounds constituting a music piece; and attributes associated with the generation of the sounds, and a signal generating section configured to generate signals to be inputted to the movement-force giving mechanism, according to the performance instruction data obtained by the performance-instruction-data obtaining section.

15. A method of producing a drive mechanism of a lifting rail for a musical instrument which comprises: dampers each configured to come into contact with a sound generating member provided for a corresponding one of a plurality of keys for generating a sound of one of a plurality of pitches that are generated by the musical instrument, so as to suppress a vibration of the sound generating member; damper levers each connected to a corresponding one of the dampers directly or indirectly for moving the damper away from the sound generating member in accordance with depression of a corresponding one of the plurality of keys; and a lifting rail having a bar-like configuration and configured to operate all of the damper levers, such that each of the dampers is spaced apart from the sound generating member, wherein the drive mechanism comprises: a connection member connected to one end of the lifting rail; and a movement-force giving mechanism configured to move the lifting rail via the connection member in accordance with signals to be inputted thereto, the method comprising the steps of:

inserting an insertion member of the connection member into a hollow portion of the lifting rail which is open at the one end of the lifting rail;

permitting a contact portion of the connection member to come into contact with the one end of the lifting rail when the insertion member is inserted in the hollow portion by a prescribed distance; and fixing the connection member and the lifting rail in a state in which the contact portion is in abutting contact with the one end of the lifting rail.

* * * * *